US006764261B1

(12) United States Patent
Stadler

(10) Patent No.: US 6,764,261 B1
(45) Date of Patent: Jul. 20, 2004

(54) LOCKING DEVICE AND METHOD FOR CATCH BASIN AND MANHOLE COVERS, AND THE LIKE

(76) Inventor: David Stadler, 28421 Santa Barbara, Lathrup Village, MI (US) 48076

( * ) Notice: Subject to any disclaimer, the term of this patent is extended or adjusted under 35 U.S.C. 154(b) by 0 days.

(21) Appl. No.: 10/295,007

(22) Filed: Nov. 13, 2002

Related U.S. Application Data

(60) Provisional application No. 60/402,757, filed on Aug. 12, 2003, and provisional application No. 60/350,715, filed on Nov. 13, 2001.

(51) Int. Cl.[7] ..... F16B 21/00

(52) U.S. Cl. ..... 411/342; 411/340; 411/344

(58) Field of Search ..... 411/340, 342, 411/343, 344, 345, 346, 341; 29/525.02, 525.11

(56) References Cited

U.S. PATENT DOCUMENTS

| | | | | | |
|---|---|---|---|---|---|
| 1,228,512 | A | * | 6/1917 | Zifferer | 411/346 |
| 2,933,969 | A | * | 4/1960 | Huyssen | 411/346 X |
| 3,127,808 | A | * | 4/1964 | Drybread, Sr. | 411/346 |
| 4,283,986 | A | * | 8/1981 | Peterson et al. | 411/346 X |
| 4,449,873 | A | * | 5/1984 | Barth | 411/346 X |

FOREIGN PATENT DOCUMENTS

| | | | | |
|---|---|---|---|---|
| GB | 1399437 | * | 7/1975 | 411/346 |

* cited by examiner

*Primary Examiner*—Neill Wilson
(74) *Attorney, Agent, or Firm*—John R. Benefiel

(57) ABSTRACT

A locking device and method for securing a cover as for a catch basin or manhole in position including two elongate members pivotally connected together end to end so as to be able to articulate. The members are held aligned while being inserted through a cover opening suspended in said opening on a flange on the upper member, the lower member then released to be angled by a spring force to wedge against sidewall and an edge of the cover opening. A bolt extending through the top threaded into a trunnion extending across an intermediate space of the lower member draws the lower member up to create a powerful wedging action to prevent cover removal. The bolt head is recessed into the flange and configured with a special shape engageable only with a special tool to be tamper resistant. A protective plastic cap covers the bolt head and has protrusions sheared off when the cap is removed to provide a tamper indication. A miniature radio transmitter can be installed beneath the cap to transmit an alarm signal when the cap is removed. The locking device is used with a modified manhole cover by installing an adaptor sleeve defining a rectangular opening through which the locking device is inserted, and by connecting an extension arm to the lower member bottom end by use of a shear pin and pivot bolt allowing release of the locking device and cover in the event of an explosion.

33 Claims, 6 Drawing Sheets

LOCKING DEVICE AND METHOD FOR CATCH BASIN AND MANHOLE COVERS, AND THE LIKE

CROSS REFERENCE TO RELATED APPLICATION

This application claims the benefit of U.S. provisional Ser. No. 60/350,715, filed Nov. 13, 2001 and U.S. provisional Ser. No. 60/402,757, filed Aug. 12, 2003.

BACKGROUND OF THE INVENTION

This invention concerns locking devices and methods, more particularly such devices and methods as applied to covers used for catch basins and manholes installed in roadways for access to utilities, i.e., water, gas, communications, electricity. These covers are provided in order to keep out debris but also to present a supporting surface for pedestrians and vehicles on the surrounding roadway surface. If the covers are removed, the opening to a catch basin or manhole presents a severe hazard to vehicles and pedestrian traffic. Removal of these covers by vandals or scavengers has become an increasing problem which has created an urgent need for some means for securing the covers in place. There are no locking devices incorporated in existing catch basin and manhole covers such that providing a simple retrofit for existing covers is highly desirable. Such devices must be rugged to withstand traffic and weather and the efforts of vandals or terrorists to remove them. The large numbers involved dictate a simple installation method to minimize labor costs. The device must not present an obstruction in the roadway, particularly for snow plows, nor a tripping hazard to pedestrians.

It is the object of the present invention to provide a locking device and method which can quickly be installed to provide a simple retrofit to existing manhole and catch basin covers.

It is a further object to provide such a device which is rugged and able to withstand abuse and heavy traffic and reliably secure such covers in place without creating an obstruction in the roadway.

SUMMARY OF THE INVENTION

These objects and others which will be appreciated upon a reading of the following specification and claims are achieved by providing a locking device insertable into an opening in the cover adjacent a sidewall of the cover frame. The device is comprised of an upper and a lower member which are connected to each other end-to-end so as to allow articulation of the lower member to install the device, the members are initially set in an end-to-end alignment and are inserted into the cover opening. The members are held in end to end alignment with a detent mechanism including interfit detent features and the respective members held in that position by one or more springs so as to connected exert a force pulling the members together to maintain the interfit detent features in engagement.

A bolt having a tamper resistant head extends through a hole in the upper member and is left hand threadably received in a trunnion member rotatably mounted to the lower member extending across a space defined by space sidewalls included in the lower member. The bolt can be pushed down against a bottom wall of the upper member to counter the spring force and thereby allowing disengagement of the interfit detent features. The spring or springs then cause the lower member to be pivoted on the trunnion with respect to the upper member and thereby angled towards the sidewall adjacent the opening until the bottom end of the lower member engages the same. Teeth are preferably formed along the bottom end edge of the lower member engaged with the sidewall.

Notch contours on the upper end of the lower member at the same time are moved to engage an edge of the cover opening through which the device is inserted.

The bolt is then driven on its threaded connection to the trunnion by a special tool socket to draw the lower member up, the upper member having a flange overlying the cover to provide a reaction surface. This creates a powerful wedging of the lower member between the sidewall and opening edge, preventing lifting of that side of the cover. By installing four locking devices, two on each side of the cover, the cover is wedged securely in its opening to prevent its removal.

The bolt head is received within a recess in the top of the upper member and has driving contour requiring a special tool to prevent removal of the locking device by the use of standard tools.

A plastic cap is placed over the bolt head and in the recess to prevent weathering of the bolt threads and the entrance of plugging dirt and debris. Special features on the cap provide a tamper indication if the cap is removed.

A special version of the device is used for manhole covers, in which an adapter sleeve is fitted into a round hole bored into the manhole cover and secured to the cover with bolts received in threaded holes formed into the underside of the manhole cover. The upper member is received in a central rectangular opening in the adapter sleeve, the upper member having a round flange smoothly overlying the adapter sleeve top surface adjacent the rectangular opening.

An extension arm is secured to the bottom end of the lower member to enable the toothed bottom edge of the extension arm to reach a sidewall edge located further from the manhole cover opening in which the locking device is inserted. The extension arm is attached using a pivot bolt and a shear pin so that the cover can be released and blown free in the event of a gas explosion to prevent structural damage. The adapter sleeve presents an opening wall which projects downwardly to present an edge engageable with the lower member notched contours to establish a wedging lock as in the catch basin version of the locking device.

A special radio signaling device can also be built into the cap, able to provide a remote alarm via a repeater amplification to a central station if tampering is detected, which can also be used to locate a catch basin or manhole when a cover has been removed or tampered with.

DETAILED DESCRIPTION

Figure 1:
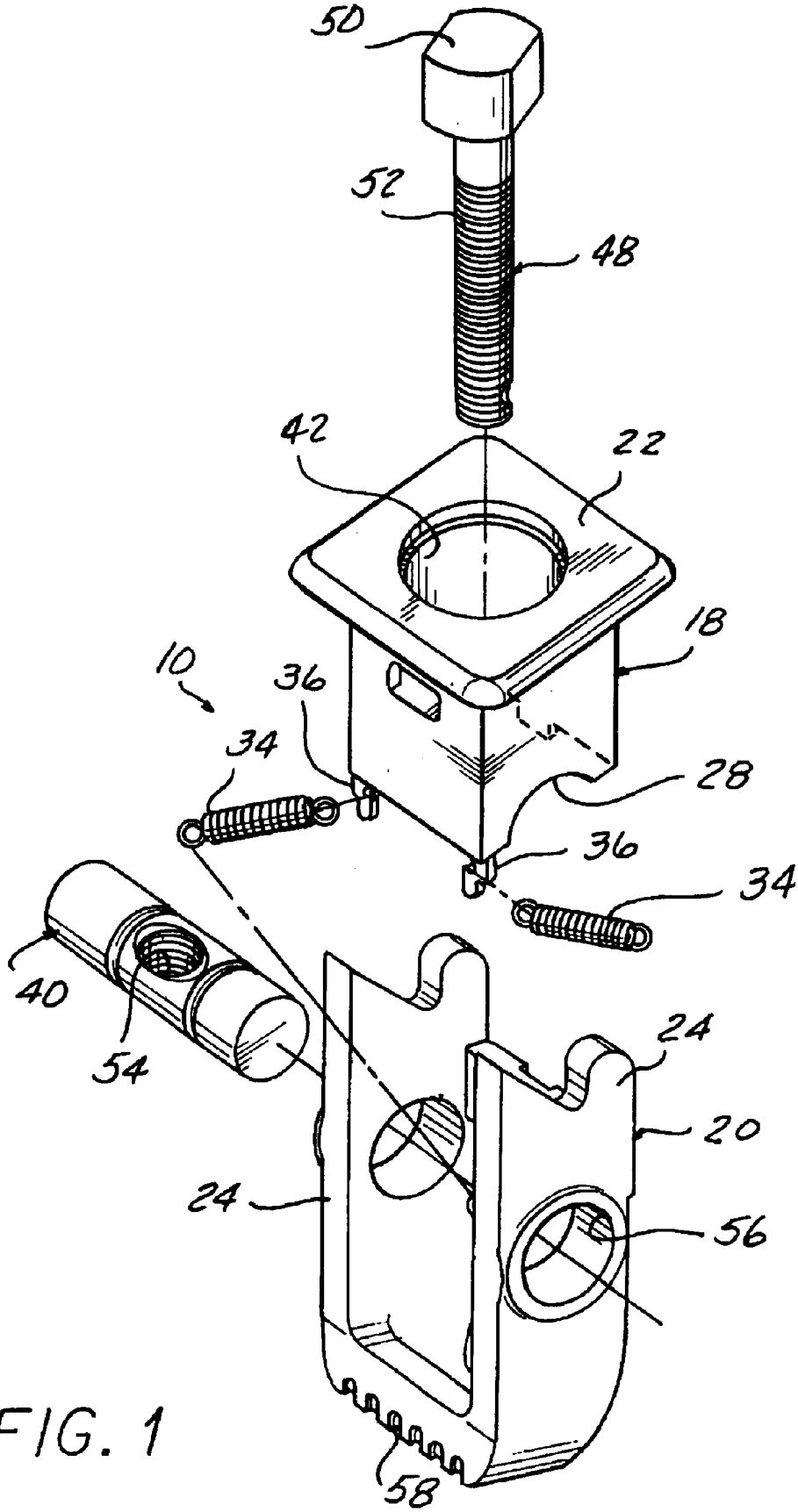
FIG. 1 is an exploded perspective view of a locking device according to the present invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the locking device 10 according to the present invention is designed to be installed by being first inserted into an opening 12 in a catch basin cover 14 overlying an opening defined by a sidewall 16.

Figure 2:
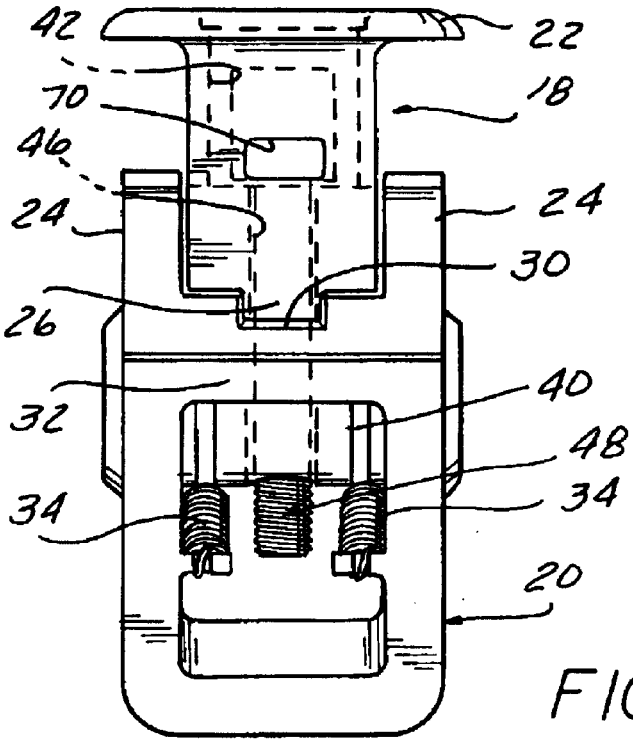
FIG. 2 is a front view of a locking device according to the present invention.
Figure 3:
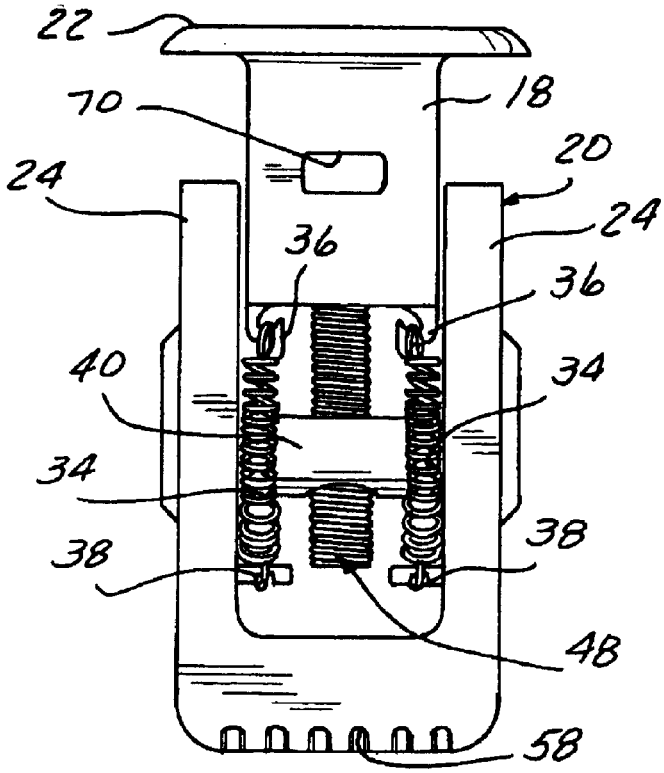
FIG. 3 is a rear view of the locking device shown in FIGS. 1 and 2.
Figure 4:
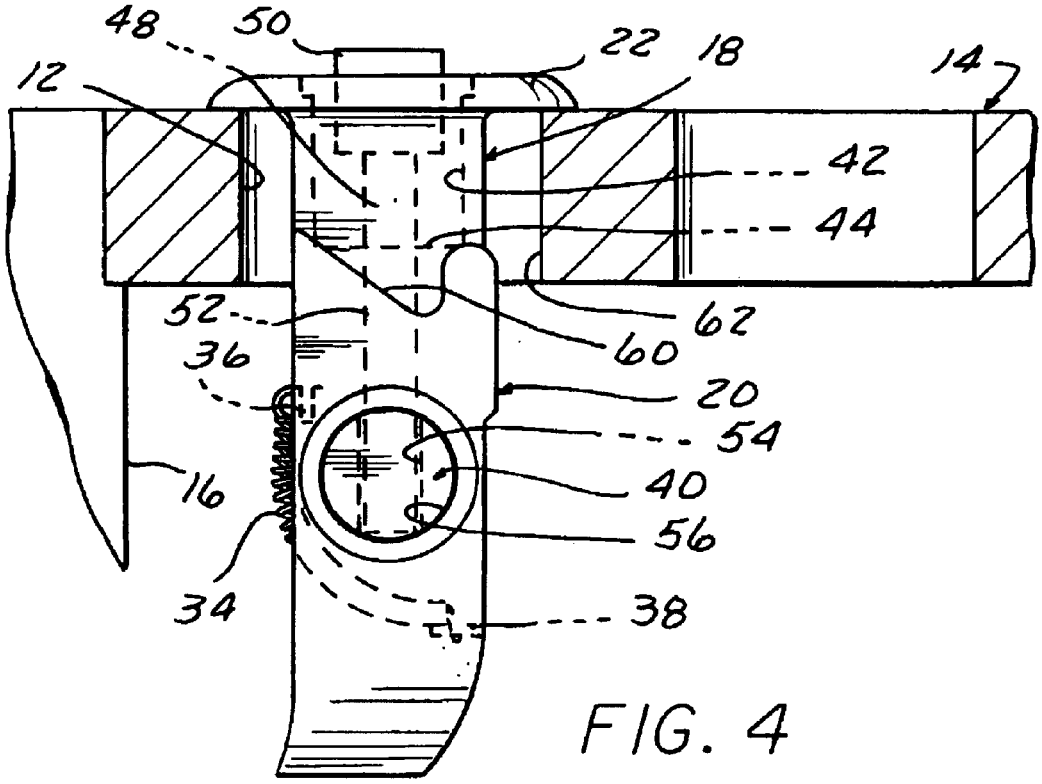
FIG. 4 is a side view of the locking device shown in FIGS. 1–3 inserted in a catch basin cover, shown with the adjacent sidewalls in fragmentary form.

The locking device 10 includes a generally rectangular upper and lower moderately elongated members 18, 20, which are preferably constructed of high strength steel and connected together end-to-end in a manner allowing articulation therebetween. Prior to installation, the members 18, 20 are set in an end-to-end aligned position as shown in FIGS. 2 and 4. The upper member 18 has a flange 22 at the top which overlies the cover structure adjacent the opening 12 to suspend the locking device hanging through the opening 12 and into the space below the cover 14. The edges of the flange 22 are is rounded to present a smooth contour.

The upper member 18 is generally rectangular and is sized to be received between a pair of spaced upstanding walls 24 included in the lower member 20. The upper member 18 has a depending rectangular tab 26 on one side of a radiused bottom wall 28 which is interfit to a rectangular recess 30 in a cross web 32 at the rear of the bottom member 20 extending between the walls 24. The tab 26 and recess 30 comprise detent features of a detent mechanism for releasably holding the upper and lower members 18, 20 in their initially set aligned position by preventing rotation of the lower member 20 about a trunnion 40. The detent mechanism also includes one or more coil springs 34 which are each connected at either end to the upper and lower members 18, 20.

For this purpose, slotted ears 36 are formed on the bottom of one side of the upper member 18 and slotted ears 38 are formed on the inside of the spaced walls 24 on the opposite side of bottom member 20. The springs 34 thus extend down and around trunnion 40 and over to the lower tabs 38, exerting an end to end pulling force on the members 18, 20 tending to maintain engagement of the tab 26 and recess 30.

The springs 34, since they are wrapped around the trunnions 40 also urge relative rotation of the upper and lower members 18, 20, but this is resisted by the interfitting engagement between the tabs 26 and recess 30 preventing rotation of the upper and lower members 18, 20 about the trunnion 40.

Figure 6:
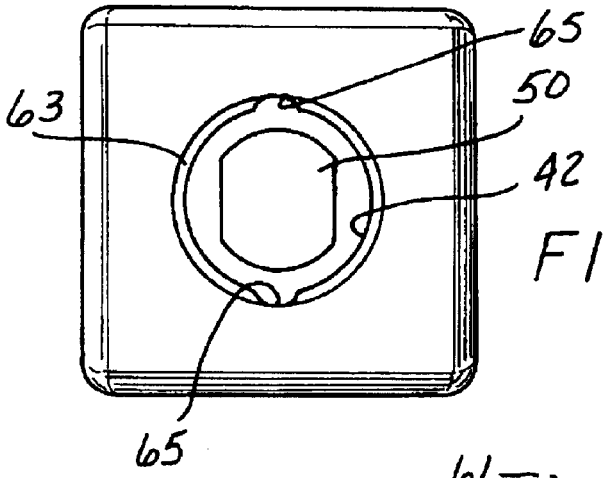
FIG. 6 is a top view of the upper member showing the tamper resistant bolt shape.

The upper member 18 has a recess in its upper end comprised of cylindrical bore 42 extending into the top thereof down to a bottom wall 44. An aligned smaller diameter through hole 46 extends through the bottom wall 44 and slidably receives a bolt 48 therein. Bolt 48 has a tamper resistant shaped head 50 (seen in FIG. 6) and a left hand threaded body 52 which is threadably engaged with a through cross bore 54 extending through the trunnion 40. Trunnion 40 is rotatable in aligned bores 56 in the spaced walls 24. The bolt 48 is initially installed so as to not engage the bottom wall 44.

After insertion of the locking device 10 in the opening 12, the bolt head 50 is pushed down against the bottom wall 44 to push the lower member 18 down and away from the upper member 18 against the resistance of the springs 34.

Figure 5:
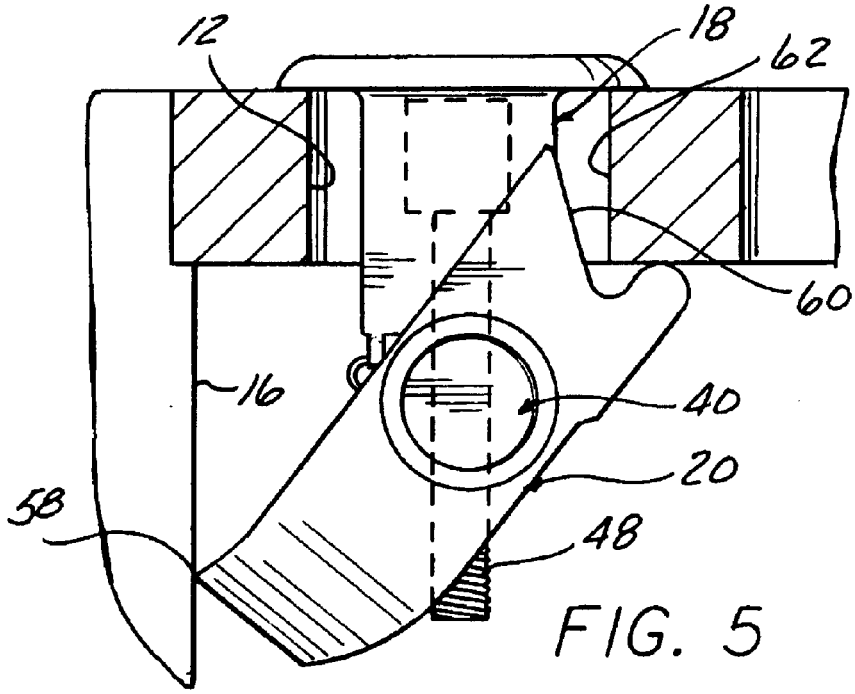
FIG. 5 is a side view of the inserted locking device of FIG. 4 in the articulated condition of the upper and lower members.

This repositions the recess 30 down to disengage the tab 26, which allows the springs 34 to rotate the lower member 20 about trunnion 40 as shown in FIG. 5 until the toothed bottom end 58 engages the catch basin sidewall 16.

At the same time, a notch contour 60 in the top of each spaced wall 24 are both angled towards the bottom edge 62 of the opening 12 in the cover 14 to engage the same (FIGS. 4 and 5).

Figure 7:
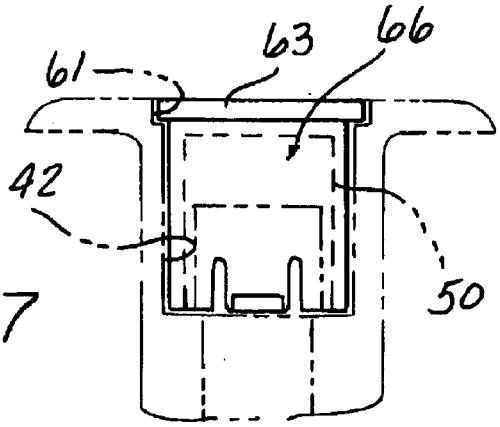
FIG. 7 is a side view of the upper member in phantom lines, showing the tamper resistant bolt seated with a cap in place on the bolt head covering the upper member recess.

The bolt 48 is then rotated by use of a special socket tool (not shown) contoured to engage the angled unequal flats 64 on the bolt head 50 (FIG. 7). The size of the bore 70 allows the tool to engage the bolt head 50 but leaves insufficient clearance to be engaged by adjustable tools to be tamper resistant.

Advance of the bolt 48 causes its left hand thread engagement to lift the now articulated lower member 18 to securely wedge the same tightly between the sidewall 16 and edge 62. When four devices 10 are installed, two on each side of the catch basin cover, this will preventing removal of the cover 14.

Figure 8:
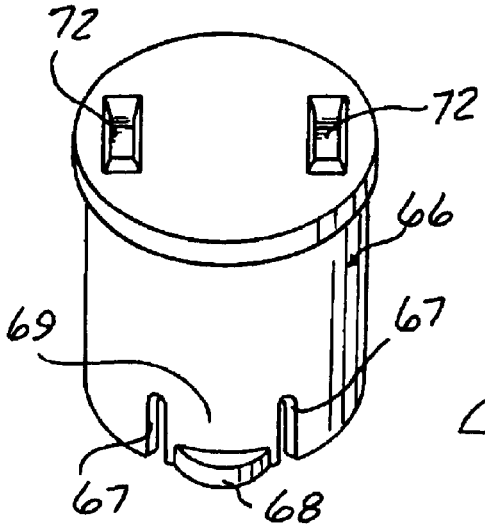
FIG. 8 is a perspective view of the plastic flanged cap shown installed in FIG. 7.

A plastic cap 66 (FIGS. 7, 8) is provided to be fit over the bolt head 50 to prevent debris to enter the space around the bolt head 50.

The cap 66 has protrusions 68 on portions 69 defined by slots 67 snap fit into drain openings 70 provided in the bottom of the bore 42 the upper member 18. The bore 42 is formed with shallow grooves 65 to aid in aligning the protrusions 66 and a shallow counterbore 61 to accommodate a cap flange 63'. The protrusions 66 are broken off when the cap 66 is removed by use of a pronged tool engaging pockets 72 in the cap to give evidence of tampering.

Figure 10:
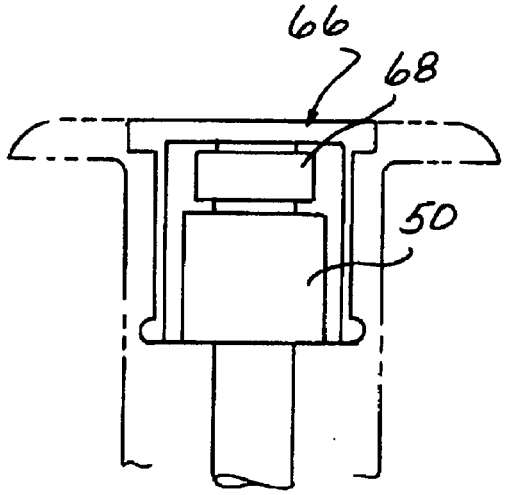
FIG. 10 is a diagrammatic view of an installed cap with a radio transmitter monitor.
Figure 9:
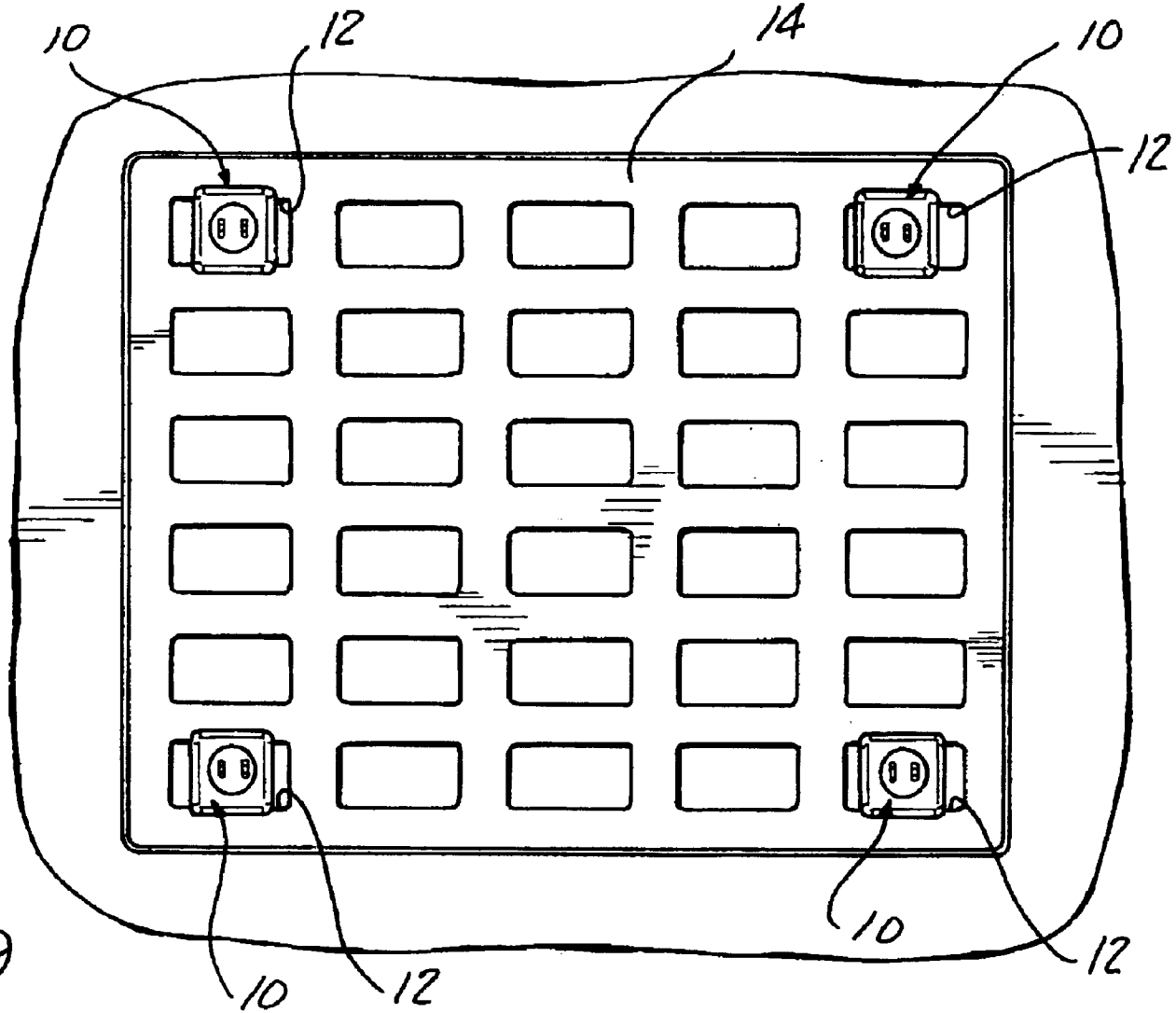
FIG. 9 is a top view of a catch basin cover with four locking devices according to the invention installed therein.

FIG. 10 shows a miniature radio transmitter-battery unit 78 installed beneath the cap 66, which can transmit a signal via a repeater amplifier system to a remote location. Upon removal of the cap 66, the radio signal is interrupted so that an intrusion alarm can be triggered at the remote location. This signal can also be varied to locate a catch basin without a cover.

Figure 11:
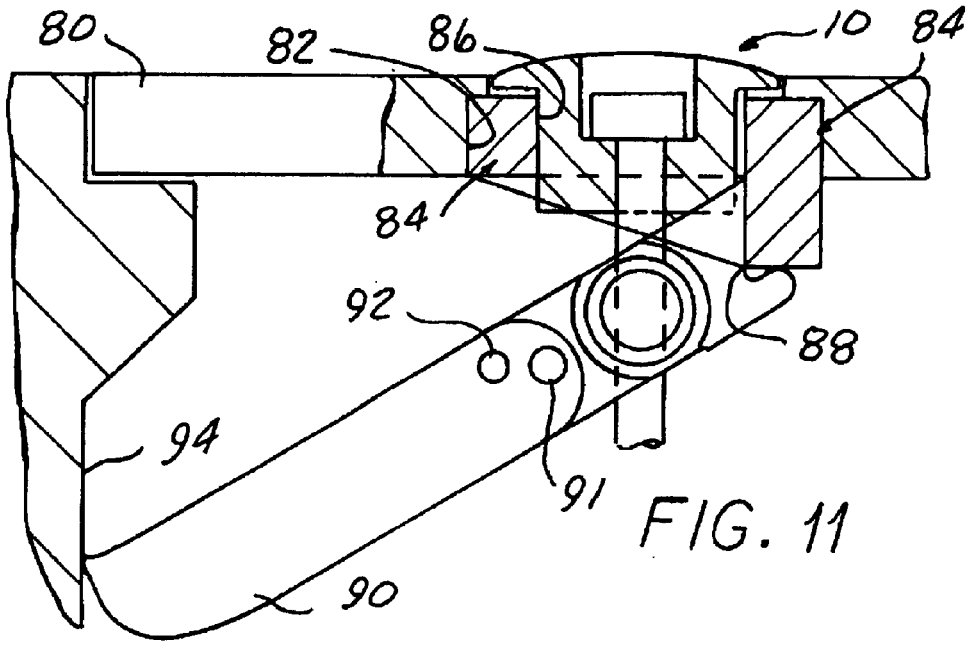
FIG. 11 is a side view of an installed modified locking device having a configuration suited to the manhole covers shown, with adjacent fragmentary portions of the manhole cover frame sidewall shown in section.
Figure 14:
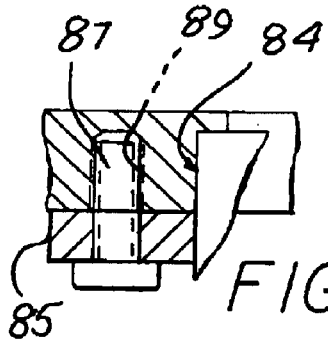
FIG. 14 is a sectional view of fragmentary portion of the manhole cover and adapter sleeve showing one of the attachment ears and bolts.
Figure 12:
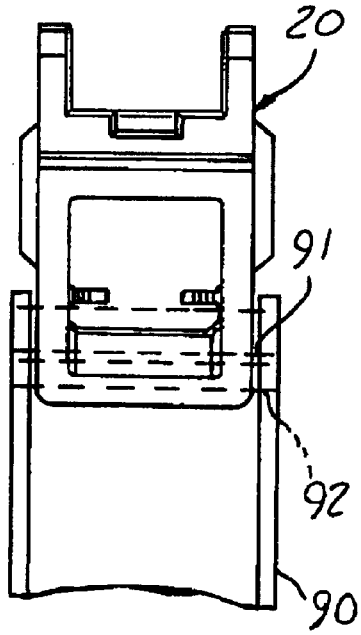
FIG. 12 is a plan view of a manhole cover with the locking device installed.
Figure 13:
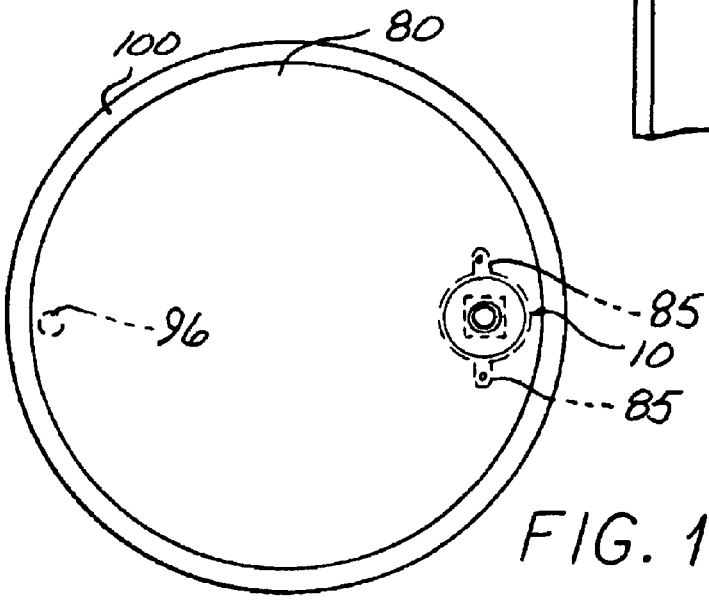
FIG. 13 is a front view of the lower member of the manhole cover locking device shown in FIG. 11, with a fragmentary portion of the extension arm installed thereon.

The device 10 can be adapted for use with a modified manhole cover 80, as shown in FIG. 11, in which a hole 82 bored into the under side of the manhole cover 80 to be able to receive an adapter sleeve 84 fixed in the hole 82 by ears 85 and bolts 87 threaded into holes 89 machined into the underside of the cover 80 (FIG. 14). A rectangular opening 86 is formed in the adapter sleeve 84, extending completely through the sleeve 84. An edge 88 is created on a lower side of the sleeve 84 positioned to be engaged by the notch contours 60 as described above. The lower end of the adapter sleeve 84 is cut off at an angle as shown in FIG. 11 to provide clearance for proper articulation of the lower member 20.

The lower member 20 has an extension arm 90 secured thereto with a pivot bolt 91 an a shear pin 92 and has a toothed end engageable with manhole sidewall 94. If an explosion occurs, the shear pin 92 is severed, the extension arm 90 swings free about the axis of the pivot bolt 91 and the cover 80 is allowed to blow free.

A second bolt 96 is installed on the underside of the manhole cover 80, closely to the opposite side of the manhole cover flange 100. Optionally, a second sleeve and lock assembly can be installed in lieu of bolt 96 180° apart from each other.

I claim:

1. A locking device for a cover overlying a space defined in part by a sidewall, said cover recessed within a perimeter frame extending around said opening and having a through opening adjacent a side thereof, said device comprising:

an upper elongated member having a flange at a top end configured to suspend said upper member on said cover extending into said opening;

a recess extending into said flange and terminated by a bottom wall;

and a hole extending into said bottom wall and through a lower end of said upper member;

a threaded bolt slidably received into said hole and protruding out said bottom end of said upper member, said bolt having a head received into said recess;

a lower elongate member having spaced walls defining a space having said lower end of said upper member fit therein, said threaded bolt threadably received into a threaded hole in a trunnion rotatably supported in said lower member and extending across said space;

at least one spring connected at one end to said upper member and at another end to said lower member, said at least one spring located to urge said members together in an end to end direction and also to urge relative rotation of said members about said trunnion to articulate the same; a detent mechanism comprising a first detent feature on the bottom end of said upper member and a second detent feature on said lower member engaging said first detent feature with said members in end to end abutment so as to prevent relative rotation about said trunnion; said bolt able to push said lower member away from said upper member against said spring force to cause disengagement of said detent features allowing said members to articulate by relative rotation other about said trunnion.

2. The locking device according to claim 1 wherein said lower member is formed with at least one notched contour on an upper end rotated to engage an edge of said cover opening upon disengagement of said detent features and rotation of said lower member by said at least one spring.

3. The locking device according to claim 2 wherein a bottom end of said lower member is formed with teeth engaging said sidewall upon articulation of said upper and lower members to establish a wedging action between said lower member, said sidewall, and said opening edge.

4. The locking device according to claim 3 wherein advance of said bolt in said threaded hole of said trunnion causes raising of said lower member to increase said wedging action by the reaction of said head on said bolt engaging said bottom wall of said recess in said upper member to increase the pressure of said teeth on said lower end of said lower member against said sidewall and said notched contour against said opening edge.

5. The locking device according to claim 1 wherein said bolt head is formed with an irregular contour engageable only with a special tool to be tamper resistant after said bolt is tightened.

6. The locking device according to claim 5 wherein said bolt head is substantially enclosed in said recess after said bolt is tightened.

7. The locking device according to claim 6 further including a molded plastic cap received over said bolt head in said recess.

8. The locking device according to claim 7 wherein said cap has at least one protrusion contoured in a pocket in said recess upon being installed, said at least one protrusion deformed upon removal of said cap to provide a tamper indicator.

9. The locking device according to claim 1 wherein said lower member has a pair of spaced apart parallel walls defining said space receiving said upper member, said sides connected at a bottom end of said lower member, said trunnion received in aligned bores in said sides.

10. The locking device according to claim 9 wherein each wall of said lower member is formed with a bore aligned with the bore in the other wall, said trunnion slidably received in said bores.

11. The locking device according to claim 10 wherein said trunnion is located at an intermediate location along the length of said lower member.

12. The locking device according to claim 1 wherein two springs are provided each connected at either end to said upper and lower members respectively, said springs connected at one end to one side of one member and at the other ends to an opposite side of the other member to create said rotational force resisted by said detent mechanism.

13. The locking device according to claim 12 wherein both of said springs are partially wrapped around said trunnion in extending from said upper member to said lower member.

14. The locking device according to claim 1 wherein said detent features comprise a flat tab projecting from one member and recess in the other member, said flat tab overlying said recess with said members in said end to end aligned position.

15. The locking device according to claim 7 further including a radio transmitter located beneath said cap and activating a transmitted signal upon removal of said cap.

16. The locking device according to claim 1 wherein said cover is a manhole cover and further including an adaptor sleeve fixed in said manhole cover having said cover opening formed thereon.

17. The locking device according to claim 16 further including an extension arm fixed to the lower end of said lower member to be engageable with a manhole sidewall.

18. The locking device according to claim 17 wherein said extension arm is connected to said lower member by a shear pin which will be severed by a predetermined force to allow release of said locking device in the event of an explosion.

19. A method of securing a cover in position over a space below said cover defined in part by a sidewall, said cover recessed within a frame and having a through opening adjacent said sidewall, comprising the steps of:

pivotally connecting an upper and a lower elongated members together end to end so as to able to be articulated by being rotated about said pivotal connection;

applying a force urging said members to rotate about said pivotal connection;

aligning said members end to end and holding said members in alignment while resisting said using force and inserting the same through said cover opening;

suspending said connected members on said cover extending through said cover opening;

releasing said members to allow articulation thereof by rotation about said pivotal connection under the action of said urging force; and engaging said sidewall with a bottom end of said lower member and simultaneously engaging an upper surface of said lower member with an edge of said cover opening so as to wedge the same therebetween to secure said cover in place.

20. The method according to claim 19 further including the step of drawing said lower member up towards said upper member after engagement thereof with said sidewall and cover opening edge to increase said wedging force to join said cover against said frame.

21. The method according to claim 20 wherein said step of applying said urging force comprises the step of connecting at least one tension spring to said upper and lower members in locations tending to rotate and thereby articulate said members about said pivotal connection.

22. The method according to claim 20 wherein said step of pivotally connecting said upper and lower members together comprises the step of installing a rotatable trunnion in said lower member and threadably engaging said trunnion with a threaded bolt extending through a hole in a wall in said upper member and a threaded cross hole in said trunnion said bolt having a head seatable on said bottom wall.

23. The method according to claim 22 wherein said step of drawing said lower member towards said upper member comprises the step of rotating said bolt in said threaded hole in said trunnion with said bolt head abutting said bottom wall.

24. The method according to claim 19 wherein said step of suspending said members includes the step of forming a flange on said upper member configured to rest on surfaces adjacent said cover opening.

25. The method according to claim 22 further including the step of forming engagement surfaces on said bolt engageable only with a special tool and advancing said bolt with said special tool to be tamper resistant.

26. The method according to claim 25 further including the step of recessing said bolt head within a flange formed on said upper member.

27. The method according to claim 26 further including the step of installing a tamper indicator plastic cap over said bolt head.

28. The method according to claim 27 further including forming a contour on said lower member to securely be captured by said cover opening edge.

29. The method according to claim 19 wherein said step of holding said members in an aligned position includes the step of forming detent features on said upper and lower members and engaging the same while inserting said upper and lower members through said cover opening and thereafter releasing said engagement thereof to allow said articulation to proceed.

30. The method according to claim 19 wherein said method is applied to a manhole cover by first installing an adaptor sleeve in the undersurface, having a portion formed with a rectangular opening receiving said locking device comprising said cover opening.

31. The method according to claim 30 further including the step of installing an extension arm engageable with a sidewall of said manhole to said lower member bottom end by a shear pin able to release said locking device in the event of an explosion.

32. The method according to claim 19 further including the step of installing a plurality of said locking devices on opposite sides of said cover.

33. The method according to claim 31 further including the step of installing a bolt on the underside of said manhole cover adjacent a manhole cover flange to prevent lifting of both sides of said manhole cover.

* * * * *